US005875969A

United States Patent [19]

Grundy

[11] Patent Number: 5,875,969

[45] Date of Patent: Mar. 2, 1999

[54] SPRINKLER WITH SELF CLEANING BOWL

[75] Inventor: Michael J. Grundy, Phelan, Calif.

[73] Assignee: The Toro Company, Minneapolis, Minn.

[21] Appl. No.: 897,134

[22] Filed: Jul. 18, 1997

[51] Int. Cl.[6] ..... B05B 1/28; B05B 15/02

[52] U.S. Cl. ..... 239/113; 239/120; 239/204

[58] Field of Search ..... 239/203, 204, 239/206, 113, 112, 104, 120, 240, 106, 119

[56] References Cited

U.S. PATENT DOCUMENTS

| | | | |
|---|---|---|---|
| 3,073,529 | 1/1963 | Baker | 239/106 |
| 3,785,565 | 1/1974 | Perry et al. | 239/206 |
| 4,014,502 | 3/1977 | Sheets | 239/206 |
| 4,630,569 | 12/1986 | Dieleman | 119/1 |
| 4,681,259 | 7/1987 | Troup et al. | 239/206 |
| 4,850,538 | 7/1989 | Krahn | 239/439 |

OTHER PUBLICATIONS

Rain Bird 91DR and 95DR Rotor brochure (undated).

*Primary Examiner*—Andres Kashnikow
*Assistant Examiner*—Sean P. O'Hanlon
*Attorney, Agent, or Firm*—James W. Miller

[57] ABSTRACT

A sprinkler has an upwardly facing sprinkler bowl at the top of the sprinkler body in which water can collect during operation of the sprinkler when the riser of the sprinkler is popped up. At least one nozzle on the sprinkler comprises a siphon nozzle that has a siphon tube extending downwardly into the bowl when the riser is popped up and the sprinkler is operating. The siphon effect created in the siphon nozzle siphons water from the bowl and through the tube to eject the water in the bowl along with the main water flow through the nozzle. The siphon tube is flexible to collapse or bend within the bowl when the riser retracts.

20 Claims, 2 Drawing Sheets

SPRINKLER WITH SELF CLEANING BOWL

TECHNICAL FIELD

This invention relates to a sprinkler having a body that includes an upwardly facing basin or bowl. More particularly, this invention relates to a sprinkler having means for removing water from the sprinkler bowl during operation of the sprinkler.

BACKGROUND OF THE INVENTION

A sprinkler is known which has its own control valve for turning the sprinkler on and off. Such a sprinkler is often referred to as a "valve in head" sprinkler which means that the control valve for that sprinkler is built as part of the sprinkler head, i.e. that the valve is "in" the head. Valve in head sprinklers are typically larger sprinklers for watering larger areas. They are often used on golf courses or other large turf applications.

Some control valves in "valve in head" sprinklers are hydraulically actuated using a small bypass water flow to a pilot valve. The pilot valve water flow is typically dumped into the sprinkler bowl. This water can flood out of the bowl and onto the ground surrounding the sprinkler. This flooding can unduly soften and thus damage the turf surrounding the sprinkler.

Moreover, if water is left standing in a sprinkler bowl for an extended time, it can become laden with dirt and other debris. In extreme cases, this might impede the proper performance of the sprinkler. For example, it might prevent the sprinkler riser from properly popping up or down or might prevent the nozzle from rotating as it should. Accordingly, dumping the pilot valve water flow into the sprinkler bowl has various disadvantages.

Certain prior art sprinklers have attempted to solve this problem by NOT dumping the water flow from the pilot valve into the sprinkler bowl. These sprinklers use an extra return tube to carry the pilot valve water flow back into the main water flow inside the sprinkler body. Thus, the pilot valve water flow is merged back into the main water flow through the sprinkler body. Eventually, the pilot valve water flow is ejected through the sprinkler nozzles as part of the main water flow.

The approach detailed above is effective for preventing the pilot valve water flow from entering the sprinkler bowl. However, the pilot valve water flow is not the only water that can enter the sprinkler bowl. For example, water already standing on the ground or rain water can drain or flood into the sprinkler bowl. This is particularly true when the sprinkler is in a low area in the irrigation system. Preventing the pilot valve water flow from reaching the sprinkler bowl does nothing to remove any ground or rain water that might reach the sprinkler bowl.

SUMMARY OF THE INVENTION

One aspect of this invention is to provide a sprinkler having some means for removing water from the sprinkler bowl, regardless of the source of that water, during operation of the sprinkler.

One aspect of this invention is found in a sprinkler which comprises a sprinkler body having an upper portion with an upwardly facing bowl in which water can collect. A means is provided for removing water from the bowl of the sprinkler during operation of the sprinkler.

In another aspect of this invention, the water removing means comprises a siphon nozzle that uses the water flow passing through the nozzle to create a siphon effect and a siphon tube that extends downwardly from the nozzle into the bowl. Water is siphoned from the bowl through the tube and is ejected from the nozzle along with the main water flow.

Another aspect of this invention comprises a siphon nozzle that is flushed during initial pressurization of the sprinkler. A small portion of the water initially entering the sprinkler is diverted through the siphon passageway in the nozzle in a flushing action. After the sprinkler is fully pressurized, the flushing action is shut off or blocked to allow the siphon action to be effective.

A final aspect of this invention comprises a siphon tube formed from a flexible material to allow the siphon tube to be bent and compressed when the pop-up riser portion of the sprinkler is retracted.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
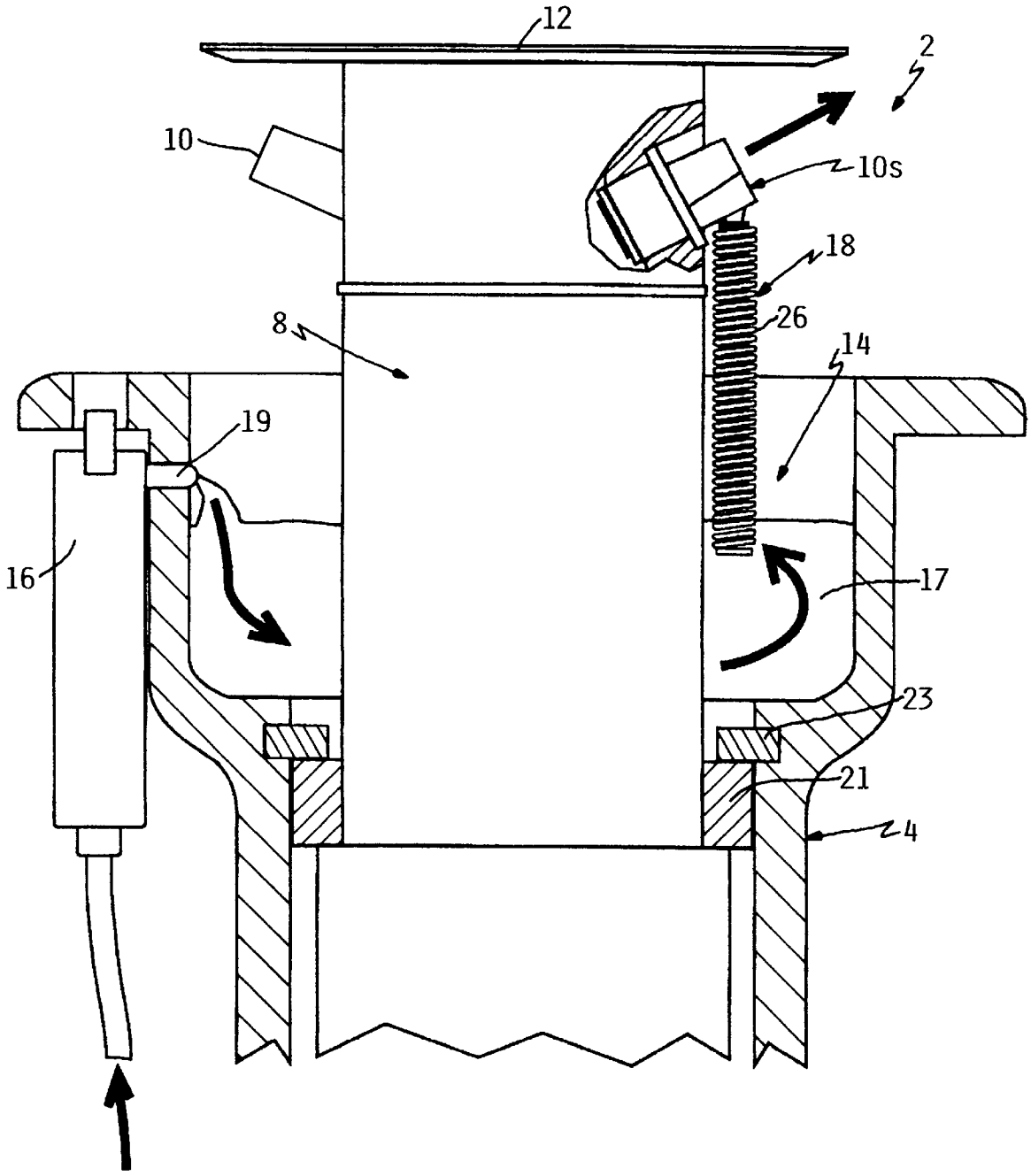
FIG. 1 is a side elevational view, partly in cross-section, of a sprinkler according to this invention, particularly showing the siphon nozzle and siphon tube for siphoning water from the bowl of the sprinkler.

Referring first to FIG. 1, a sprinkler according to this invention is generally referred to as 2. Sprinkler 2 includes a sprinkler body 4 that is typically buried in the ground with the top of sprinkler body 4 being at ground level. Sprinkler 2 includes a pop-up riser 8 that can pop up out of sprinkler body 4 to elevate sprinkler nozzles 10 above ground level during operation of sprinkler 2. The popped up orientation of riser 8 is shown in FIG. 1. When the water is turned off and sprinkler 2 is not in operation, riser 8 retracts back down into sprinkler body 4 until a cap 12 seals against the top of sprinkler body 4 to close off sprinkler body 4.

Sprinkler body 4 includes one or more sprinkler nozzles 10 through which water is ejected to the side of sprinkler 2 in one or more streams. Some drive mechanism (not shown) of any of the numerous types known in the art is housed inside riser 8 to rotate sprinkler nozzles 10 around a substantially vertical rotational axis. Thus, the streams exiting nozzles 10 will be rotated around to water a circular pattern. Sprinkler 2 is shown having two nozzles 10 pointing outwardly from opposite sides of riser 8 as is typical in a full circle sprinkler. However, nozzles 10 could be grouped together on one side of riser 8 in a part circle sprinkler with nozzles 10 being oscillated back and forth by the drive mechanism to cover a partial circular pattern of any desired arc.

Sprinkler body 4 has a basin or bowl 14 at the top thereof which forms the upper portion of sprinkler body 4. Sprinkler bowl 14 is upwardly open such that bowl 14 is open to the atmosphere when riser 8 is popped up and cap 12 is lifted. Water is then free to drain down into bowl 14 from the ground or to flow out of bowl 14 onto the ground. The word "bowl" is not meant to be restrictive as to the shape of the upwardly open cavity to which this word is applied, but is simply the word used in the art to refer to this portion of sprinkler 2, i.e. the cavity which houses nozzles 10 when riser 8 is retracted. Thus, sprinkler bowl 14 is not limited to the configuration shown in FIG. 1, but could have many different shapes and/or sizes.

Sprinkler 2 shown in FIG. 1 is a hydraulically operated, valve in head sprinkler. A pilot valve 16 is located on the side of sprinkler body 4 adjacent bowl 14. A small bypass water flow enters pilot valve 16 to actuate pilot valve 16 and thereby turn on the main control valve that is built into sprinkler 2 to allow water to flow into and through sprinkler 2. The bypass water flow exits pilot valve 16 and is dumped through a discharge port 19 into sprinkler bowl 14 where it forms a small pool of water 17. The pool of water 17 is retained in bowl 14 and prevented from draining downwardly out of bowl 14 by a riser seal 21 held beneath a snap ring 23. The description of sprinkler 2 thus far corresponds to a conventional hydraulically operated, valve in head sprinkler that has been sold by The Toro Company, the assignee of this invention, for many years.

This invention relates to a novel and unique means for removing water from sprinkler bowl 14 during operation of sprinkler 2. This water removal means comprises a siphon nozzle 10*s* (the s standing for siphon) carried on riser 8 as one of the nozzles 10 and a siphon tube 18 extending down from siphon nozzle 10*s* into bowl 14 of sprinkler 2 when riser 8 is popped up. As water flows through riser 8 and out through nozzle 10*s*, a siphon effect is created in siphon nozzle 10*s*. This siphon effect is sufficiently strong to siphon the water 17 standing in bowl 14 up through siphon tube 18 and into siphon nozzle 10*s* where the siphon water is combined with the main water flow through siphon nozzle 10*s*. Thus, the siphon water is siphoned up into nozzle 10*s* and is ejected out through nozzle 10*s* becoming part of the main water flow through nozzle 10*s*.

Figure 2:
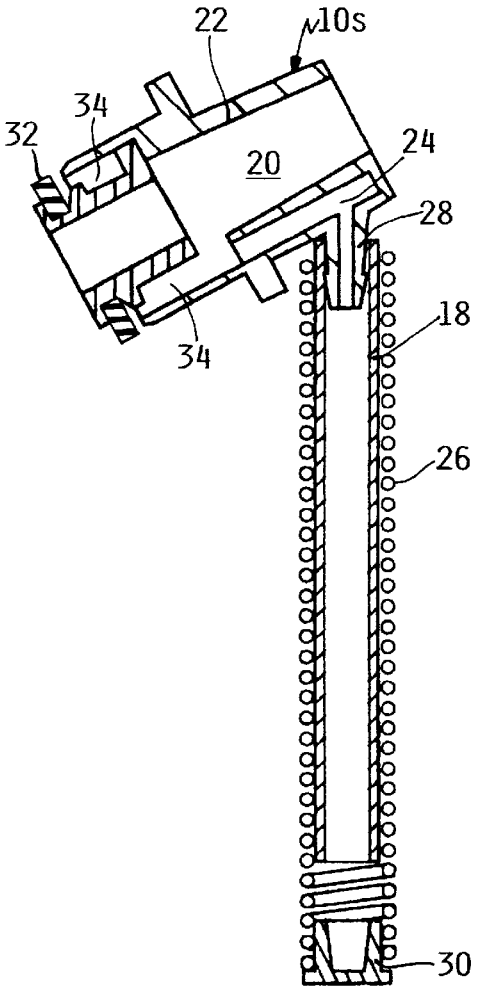
FIG. 2 is an enlarged cross-sectional view of the siphon nozzle and siphon tube of FIG. 1.

At least one nozzle 10 on sprinkler 2 needs to comprise siphon nozzle 10*s*, though more than one nozzle 10 could be a siphon nozzle if so desired. Referring to FIG. 2, siphon nozzle 10*s* includes a main flow passageway 20 through which the main water flow passes as it travels through nozzle 10*s*. Main flow passageway 20 of siphon nozzle 10*s* includes a constricted or tapered section 22 forming a venturi. As is well known, flow of a fluid through a venturi creates a siphon or suction force. A siphon passageway 24 is provided in siphon nozzle 10*s* that connects to the low pressure area of venturi 22.

An elongated siphon tube 18 is connected to the outlet end 28 of siphon passageway 24 in siphon nozzle 10*s*. Use of a flexible plastic or rubber material to form tube 18 is preferred. This allows siphon tube 18 to be long enough to reach down into bowl 14 a sufficient distance when riser 8 is popped up, and to collapse or bend when riser 8 retracts and tube 18 is forced against the bottom of bowl 14. While tube 18 could be made of a rigid plastic material, a long rigid tube 18 would engage the bottom of bowl 14 before riser 8 was fully retracted. Thus, any rigid siphon tube 18 would have to be relatively short and would not reach very far down into bowl 14. Using a flexible siphon tube as described herein allows tube 18 to be longer to reach down close to the bottom of bowl 14 while still allowing riser 8 to be fully retracted into sprinkler body 4 when the water is shut off.

Many plastic or rubber materials take a set when they are repeatedly bent in the same way. If this were to happen to siphon tube 18, siphon tube 18 may not reach down as far as is desired into sprinkler bowl 14 when riser 8 is popped up, thus somewhat defeating the purpose of using a flexible tube in the first place. Accordingly, it is preferred that siphon tube 18 be mounted and carried inside an elongated spring 26 with the top coil or so of spring 26 being carried over the barbed outlet end 28 of siphon passageway 24 on siphon nozzle 10*s*. Spring 26 will thus help support and mount tube 18 and will straighten tube 18 out when riser 8 is fully popped up to ensure that tube 18 reaches down into sprinkler bowl 14 to the designed depth.

Spring 26 also serves to filter the water entering the lower end of siphon tube 18. If the coils of spring 26 are relatively close together, any debris larger than the spacing between the coils will be prevented from passing through spring 26. This helps ensure that siphon tube 18 does not become clogged or plugged with large debris particles. If spring 26 were not used to support tube 18, it would be desirable to use some other type of screen or filter around the lower open end of siphon tube 18.

A plug 30 is inserted into the lower end of spring 26 to prevent the lowermost coil of spring 26 from catching on the bottom of bowl 14, particularly as sprinkler nozzle 10 rotates around relative to bowl 14 during operation of sprinkler 2. If the lower coils of spring 26 could be wound sufficiently tightly to close off spring 26 at its lowermost end so there are no outwardly protruding surfaces which might catch on bowl 14, plug 30 could be deleted.

Figure 3:
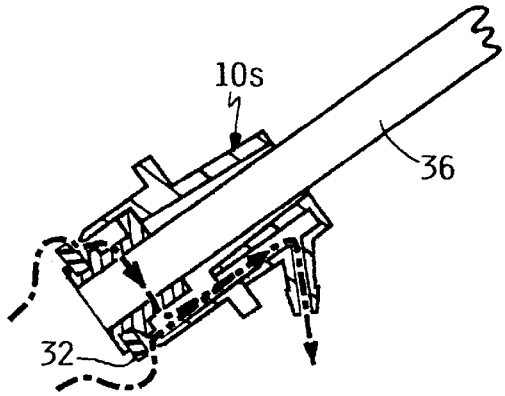
FIG. 3 is a schematic view of the siphon nozzle shown in FIG. 1, particularly illustrating the flushing action through the siphon passageways during initial pressurization of the sprinkler.

Sprinkler nozzle 10 preferably further includes a means for flushing out siphon passageway 24 during initial pressurization of sprinkler 2 when water pressure is first applied to sprinkler 2. This flushing means comprises a flexible, but relatively stiff, rubber washer 32 at the rear end of siphon nozzle 10*s*. When water is first turned on to sprinkler 2, but before full pressurization is reached, washer 32 is spaced from an annular flush passageway 34 that connects to siphon passageway 24. See FIG. 3. Thus, a small portion of the water entering nozzle 10*s* can flow around washer 32, through flush passageway 34, and downward through siphon passageway 24 in a reverse or backflow direction to flush out any small debris particles that might have entered siphon passageway 24 or siphon tube 18.

Figure 4:
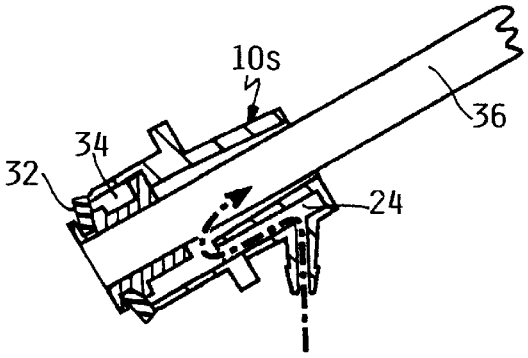
FIG. 4 is a schematic view similar to FIG. 3 showing the siphon nozzle of FIG. 1, but particularly illustrating the siphoning action through the siphon passageways when the sprinkler is fully pressurized.

However, once sprinkler nozzle 10 is fully pressurized, i.e. the water pressure has reached the range of pressure at which sprinkler 2 is nominally designed to operate, washer 32 is deflected to seal off flush passageway 34 at the back of nozzle 10*s*. See FIG. 4. Water can no longer enter through flush passageway 34 to pass through siphon passageway 24. Instead, all the water entering nozzle 10*s* passes straight out through main flow passageway 20 in the main water flow 36. During this passage, the siphon effect created in venturi 22 of nozzle 10*s* siphons any water in bowl 14 up through siphon tube 18 and combines such siphon water with the main water flow through nozzle 10*s*.

The stiffness of washer 32 controls the pressure washer 32 can withstand before it deforms. Thus, for sprinklers designed to operate at higher pressures, washer 32 will be somewhat stiffer than for sprinklers designed to operate at lower pressures.

Sprinkler 2 of this invention effectively solves the problem of having water stand in bowl 14 of sprinkler 2, whether such water is placed there from pilot valve 16 or enters bowl 14 from some other source. Whenever sprinkler 2 is being operated and water passes through nozzle 10*s*, a siphon is created in nozzle 10*s* and is communicated by siphon tube 18 to a spot adjacent the bottom of bowl 14. This siphon is strong enough to suck up any standing water in bowl 14 and to remove it. This is done automatically without any manual intervention.

Various modifications of this invention will be apparent to those skilled in the art. For example, the use of washer 32 and flush passageway 34, while preferred to help keep siphon tube 18 free of debris, is not strictly necessary and could be deleted. The flexible siphon tube 18 supported within a spring 26 that straightens tube 18 out when riser 8 is popped up, while again being preferred, could be replaced with other siphon tube arrangements. Thus, the scope of this invention is to be limited only by the appended claims.

I claim:

1. A sprinkler, which comprises:

(a) a sprinkler body that is suited to be buried in the ground and which is non-movable during operation of the sprinkler;

(b) a pop-up riser which is movably carried inside the sprinkler body such that the riser can vertically move back and forth within the sprinkler body between a popped up position in which the riser is extended at least partially out of the sprinkler body and a retracted position in which the riser is contained within the sprinkler body, the riser carrying at least one sprinkler nozzle thereon, the riser further including a cap at the top of the riser;

(c) wherein the upper portion of the non-movable sprinkler body has an upwardly open sprinkler bowl in which water can collect with the bowl having an upwardly facing top edge and a bottom and with the cap of the riser engaging against the top edge of the bowl when the riser is retracted and with the cap of the riser moving off the top edge of the bowl when the riser is popped up, and wherein the riser extends through the bottom of the bowl with the bottom of the bowl being sealed around the riser such that any water entering the bowl is retained in a pool therein without draining down around the riser into a lower portion of the sprinkler body; and (d) means for removing water from the bowl of the sprinkler during operation of the sprinkler.

2. The sprinkler of claim 1, further including means for flushing out the water removing means.

3. The sprinkler of claim 1, further including means for flushing out the water removing means during initial pressurization of the sprinkler when water is first turned on to the sprinkler.

4. The sprinkler of claim 1, wherein the water removing means comprises means for siphoning water from the sprinkler bowl during operation of the sprinkler.

5. The sprinkler of claim 4, wherein the means for siphoning water from the sprinkler bowl includes a venturi in the nozzle for creating a siphon force during passage of the water through the nozzle.

6. The sprinkler of claim 5, further including a siphon tube having an upper end operatively connected to the venturi of the nozzle with the siphon tube extending downwardly into the bowl.

7. The sprinkler of claim 6, wherein the siphon tube is flexible to allow the siphon tube to collapse or contract within the sprinkler bowl when the riser is retracted within the sprinkler body.

8. The sprinkler of claim 7, further including means for straightening the siphon tube out when the riser is popped up out of the sprinkler body.

9. The sprinkler of claim 8, wherein the tube straightening means comprises a spring surrounding the siphon tube.

10. The sprinkler of claim 6, further including means for flushing out the siphon tube during initial pressurization of the sprinkler when water is first turned on to the sprinkler.

11. The sprinkler of claim 10, wherein the flushing means includes means for creating a backflow of water through the siphon passageway for flushing out the water siphoning means during initial pressurization of the sprinkler when water is first turned on to the sprinkler.

12. A sprinkler, which comprises:

(a) a sprinkler body that is suited to be buried in the ground and which is non-movable during operation of the sprinkler;

(b) a pop-up riser which is movably carried inside the sprinkler body such that the riser can vertically move back and forth within the sprinkler body between a popped up position in which the riser is extended at least partially out of the sprinkler body and a retracted position in which the riser is contained within the sprinkler body, the riser carrying at least one sprinkler nozzle thereon, the riser further including a cap at the top of the riser;

(c) wherein the upper portion of the non-movable sprinkler body has an upwardly open sprinkler bowl in which water can collect with the bowl having an upwardly facing top edge and a bottom and with the cap of the riser engaging against the top edge of the bowl when the riser is retracted and with the cap of the riser moving off the top edge of the bowl when the riser is popped up, and wherein the riser extends through the bottom of the bowl with the bottom of the bowl being sealed around the riser such that any water entering the bowl is retained in a pool therein without draining down around the riser into a lower portion of the sprinkler body;

(d) a siphon nozzle that uses a main water flow passing through the nozzle to create a siphon effect; and (e) a siphon tube that extends downwardly from the nozzle into the bowl such that water is siphoned from the bowl through the tube and is ejected from the nozzle along with the main water flow.

13. The sprinkler of claim 12, wherein the siphon tube is flexible to allow the siphon tube to collapse or contract within the sprinkler bowl when the riser is retracted within the sprinkler body.

14. The sprinkler of claim 13, further including means for flushing out the siphon tube during initial pressurization of the sprinkler when water is first turned on to the sprinkler.

15. A sprinkler, which comprises:

(a) a sprinkler body;

(b) a nozzle carried on the sprinkler body which nozzle develops a siphon as water flows through the nozzle;

(c) a siphon tube that extends from the nozzle into a water containing cavity in the sprinkler body such that water is siphoned from the cavity through the tube as water flows through the siphon nozzle; and (d) means for flushing out the siphon tube.

16. The sprinkler of claim 15, further including means for automatically flushing out the siphon tube without operator intervention during initial pressurization of the sprinkler whenever water is first turned on to the sprinkler.

17. A sprinkler, which comprises:

(a) a sprinkler body having a bowl in which water can collect;

(b) a nozzle that develops a siphon as water flows through the nozzle, wherein the nozzle is carried on a pop-up riser that pops up and retracts relative to the sprinkler body when the sprinkler operates;

(c) a siphon tube that extends from the nozzle;

(d) wherein the siphon tube is flexible to allow the siphon tube to collapse or contract when the riser is retracted within the sprinkler body; and (e) means for straightening the siphon tube out when the riser is popped up out of the sprinkler body.

18. The sprinkler of claim 17, wherein the tube straightening means comprises a spring in contact with the siphon tube.

19. The sprinkler of claim 18, wherein the spring surrounds the siphon tube.

20. A sprinkler, which comprises:

(a) a sprinkler body that is suited to be buried in the ground and which is non-movable during operation of the sprinkler;

(b) a pop-up riser which is movably carried inside the sprinkler body such that the riser can vertically move back and forth within the sprinkler body between a popped up position in which the riser is extended at least partially out of the sprinkler body and a retracted position in which the riser is contained within the sprinkler body, the riser carrying at least one sprinkler nozzle thereon, the riser further including a cap at the top of the riser;

(c) wherein the non-movable sprinkler body has an upwardly open sprinkler bowl in which water can collect with the bowl having an upwardly facing top edge and a bottom and with the cap of the riser engaging against the top edge of the bowl when the riser is retracted and with the cap of the riser moving off the top edge of the bowl when the riser is popped up, and wherein the riser extends through the bottom of the bowl with the bottom of the bowl being sealed around the riser such that any water entering the bowl is retained in a pool therein without draining down around the riser into a lower portion of the sprinkler body;

(d) control valve means carried on the sprinkler body for turning water flow to the sprinkler off and on, the control valve means being hydraulically actuated and having an outlet for dumping water into the water collecting bowl of the sprinkler body; and (e) means for siphoning out the water dumped into the water collecting bowl of the sprinkler body by the control valve means, the siphoning means being powered by the water flowing through the sprinkler during operation of the sprinkler.

* * * * *